US007927530B2

(12) United States Patent
Dahringer et al.

(10) Patent No.: US 7,927,530 B2
(45) Date of Patent: Apr. 19, 2011

(54) ECCENTRIC POLYESTER- POLYETHYLENE-BICOMPO NENT FIBRE

(75) Inventors: Jörg Dahringer, Bobingen (DE); Michael Klanert, Schwabmünchen (DE); Hartmut Huth, Flörsheim (DE)

(73) Assignee: Trevira GmbH, Hattersheim (DE)

( * ) Notice: Subject to any disclaimer, the term of this patent is extended or adjusted under 35 U.S.C. 154(b) by 1057 days.

(21) Appl. No.: 10/504,472

(22) PCT Filed: Jul. 26, 2003

(86) PCT No.: PCT/EP03/08279

§ 371 (c)(1),
(2), (4) Date: Dec. 21, 2004

(87) PCT Pub. No.: WO2004/033771

PCT Pub. Date: Apr. 22, 2004

(65) Prior Publication Data

US 2005/0093197 A1 May 5, 2005

(30) Foreign Application Priority Data

Sep. 26, 2002 (DE) ..... 102 44 778

(51) Int. Cl.
*D01D 5/34* (2006.01)

(52) U.S. Cl. ..... 264/172.15; 156/229; 156/167

(58) Field of Classification Search ..... 264/175.15, 264/172.15, 172.11, 172, 13; 425/72.2, 382.2; 156/167, 229

See application file for complete search history.

(56) References Cited

U.S. PATENT DOCUMENTS

| | | | | |
|---|---|---|---|---|
| 2,931,091 | A | 4/1960 | Breen et al. | 28/82 |
| 4,159,297 | A * | 6/1979 | Mackie et al. | 264/151 |
| 4,552,603 | A | 11/1985 | Harris, Jr. et al. | 156/167 |
| 5,456,982 | A * | 10/1995 | Hansen et al. | 428/370 |
| 6,316,103 | B1 * | 11/2001 | Stanitis et al. | 428/370 |

(Continued)

FOREIGN PATENT DOCUMENTS

DE 1 202 932 10/1965

(Continued)

OTHER PUBLICATIONS

English language translation of International Preliminary Examination Report in international application PCT/EP2003/008279 bearing mail date Apr. 28, 2005.

(Continued)

*Primary Examiner* — Richard Crispino
*Assistant Examiner* — Christopher Schatz
(74) *Attorney, Agent, or Firm* — Marshall, Gerstein & Borun LLP

(57) ABSTRACT

A method for producing a skin/core type eccentric biocomponent fiber which is soft to touch and has improved latent crimp. An eccentric skin/core fiber which has a skin portion in relation to the cross-section of the fiber of 35%-70% is produced by melt spinning polyester as a core component and polyethylene as a skin component at a spinning speed of between 600 m/min-2000 m/min. The thus-obtained fiber stretches at a temperature of between 40° C.-70° C. at a ratio $W_{max}$±20% and is then compressed in a crimped manner. The fiber, which is produced in such a manner, is very soft to touch and has an additional latent crimp. The fibrer are particularly suitable for producing hygiene products such as hygienic non-woven fabrics, and all kinds of hygienic textile flat items for producing nappies, bandages, inserts, cotton buds, and the like.

19 Claims, 3 Drawing Sheets

U.S. PATENT DOCUMENTS

| | | | | |
|---|---|---|---|---|
| 2002/0025433 | A1* | 2/2002 | Chang et al. | 428/370 |
| 2003/0150473 | A1* | 8/2003 | Dave | 132/321 |

FOREIGN PATENT DOCUMENTS

| | | | |
|---|---|---|---|
| DE | 1 760 755 | | 4/1972 |
| DE | 32 02 485 | A1 | 9/1982 |
| EP | 277 707 | A2 | 8/1988 |
| EP | 496 734 | B1 | 8/1992 |
| JP | 2-139415 | | 5/1990 |
| JP | 2-145811 | | 6/1990 |

OTHER PUBLICATIONS

"Trevira Bicomponent Fibers for Airlaid Nonwovens", Dahringer et al., Chemical Fibers International, vol. 49, Oct. 1999, 2 pages.
International Search Report in PCT/EP03/08279 dated Dec. 4, 2003.
International Preliminary Examination Report in PCT/EP03/08279 dated Apr. 16, 2004.

* cited by examiner

ECCENTRIC POLYESTER-POLYETHYLENE-BICOMPONENT FIBRE

This is the U.S. national phase of International Application No. PCT/EP03/08279 filed Jul. 26, 2003, the entire disclosure of which is incorporated herein by reference.

BACKGROUND OF THE DISCLOSURE

1. Field of the Disclosure

This disclosure relates to a bicomponent fibre of the core/skin type with polyester as the core component and polyethylene as the skin component, wherein the core is arranged eccentrically and the fibre is very soft to touch and has an intensive latent crimp.

2. Related Technology

Because of their balanced property profile, polyester fibres are now among the most widely used synthetic fibres. In particular, numerous efforts have been made in recent years to develop polyester fibres with additional specific properties for certain applications.

Compared to fibres of polyolefins, such as polyethylene or polypropylene, polyester fibres have a harder feel at the same titre. In some applications, e.g. textile hygiene products, for example nappies and sanitary towels, this harder feel is seen as a disadvantage. This also applies to textile hygiene products such as corresponding non-woven fabrics.

There have been many attempts at improving this feel. For example, a polyolefin bicomponent fibre and non-woven fabrics produced from it are described in EP 0 277 707 A2.

The fibres described there may, among other things, be a core/skin fibre with a polyester core and a skin consisting of a mixture of a linear low density copolymer of ethylene and at least one alpha olefin, with 4 to 8 carbon atoms and 1 to 50% by weight of a crystalline polypropylene.

The number of crimping arcs of the core/skin filaments described therein leaves much to be desired, however, with the result that not even the voluminosity of non-woven fabrics which have been manufactured from such fibres meets all the requirements.

Not even the method proposed in DE 1 760 755 for improving the crimp, where melt spun filaments emerging from the spinning nozzle are cooled more intensely on one side, so that additional crimping arcs are formed due to the resultant asymmetrical filament structure, produces fibres which exhibit the advantages which are achieved according to this invention.

Nor do fibres such as those obtained according to JP 02 139 415 A2 meet all the requirements imposed on feel and latent crimp. The method described therein consists in spinning to side-by-side filaments a component which consists essentially of polyethylene terephthalate and a second component consisting of a polyester which is manufactured from ethylene glycol, terephthalic acid and isophthalic acid and an aromatic dicarbonic acid with sulphonate groups.

Nor does the method for manufacturing bicomponent fibres with latent crimp], described in JP 2 145 811 A, produce fibres which are characterised by a particularly soft feel and improved latent crimp.

Finally mention is also made of EP 0 496 734 B1, which describes thermally bonded fibre products which are not produced in wet conditions, including high duty fibres such as polyester, polyamide, silk, etc., which are thermally bonded with dyeable thermoplastic bicomponent fibres. In addition to the side-by-side arrangement of bicomponent fibres, the core/skin arrangement, with an asymmetrical configuration, is also mentioned.

DETAILED DESCRIPTION

Figure 1:
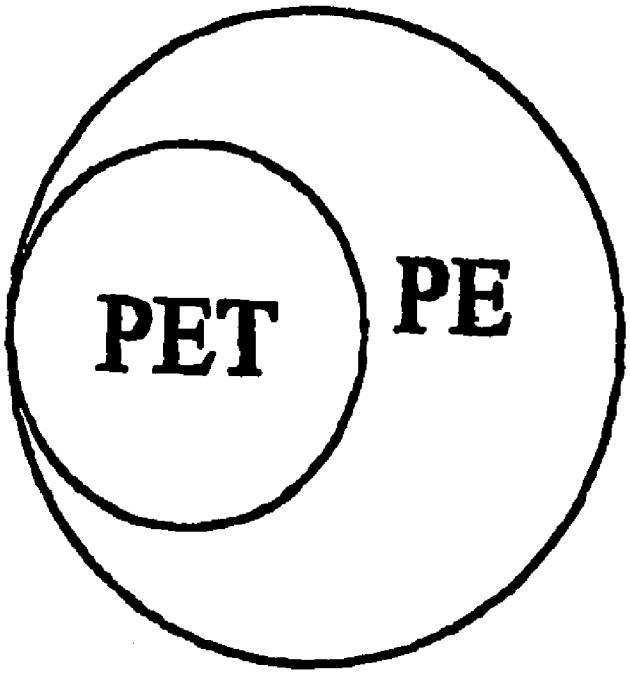
FIG. 1 shows a diagrammatic view of a cross-section of a fibre made according to the disclosure.

Although there is already a whole range of methods for manufacturing fibres, particularly bicomponent fibres with good crimp properties, there is still a demand for improved fibres of the bicomponent type which are characterised by a particularly soft touch and improved latent crimp, which can be produced in particularly in a further development process involving a thermal action and results in an increased number of crimping arcs. The disclosure provides a simple method in which an extremely high number of crimping arcs is achieved by selecting suitable process parameters, a method in fact which operates simply and at low energy costs.

The disclosure provides a method for manufacturing an eccentric bicomponent fibre of the core/skin type, with a soft feel and with improved latent crimp, by producing an eccentric core/skin fibre with a skin portion, related to the cross-section of the fibre, of 35 to 70%, by melt spinning polyester as the core component and polyethylene as the skin component, at a spinning speed of 600 m/min to 2,000 m/min, preferably 600 m/min to 1,400 m/min, drawing the fibre thus obtained at a temperature of 40 to 70° C. and at a ratio $W_{max}$ of ±20%, and then stuff-crimped. $W_{max}$ refers to the drawing ratio at which the number of arcs per cm reaches a maximum and it is determined as indicated below.

Drawing is preferably carried out at a temperature of 50° C. to 60° C. It is advantageous for the bicomponent fibre to be manufactured as a corelskin fibre with extreme eccentricity, where the extreme or maximum eccentricity is reached when the core component reaches the outer edge of the skin components, as shown diagrammatically in FIG. 1. Polyethylene terephthalate is ideal as the polyester. Conventional, and in particular commercially available types of polyethylene may be used as polyethylene for the skin component.

These include, in particular, fibre-forming linear ethylene polymers such as linear high density polyethylene (HDPE), which has a density in the range of 0.941 to 0.965 g/cm$^3$ and linear low density polyethylene (LLDPE), which typically has a density within the range of low density polyethylene (LOPE), and linear medium density polyethylene (LMDPE), i.e. densities ranging from approx. 0.1 to 0.94 g/cm$^3$.

The densities of linear ethylene polymers may be measured according to the standard ASTM D-792; a suitable definition for this can be found in ASTM D-1248.

These polymers may be manufactured using coordination catalysts; they are generally known as linear polymers because essentially they have no branched chains such as those that may be formed when monomers are polymerised to the main polymer chain.

LLDPE is a low density linear ethylene polymer in which ethylene has been polymerised with a small quantity of α-β ethylenically unsaturated alkenes which exhibit 3 to 12 carbon atoms per alkene molecule, in particular 4 to 5 carbon atoms.

It is advantageous for the fibre to be manufactured with a titre of 2 to 7 dtex, this titre indication relating to the fibre after drawing; the drawing is preferably carried out at a ratio $VV_{max}$ ranging form 1.4 to 2.4±20%.

Also disclosed is the use of the bicomponent fibres, manufactured according to the method described above for manufacturing hygiene products. The bicomponent fibres are preferred for manufacturing hygienic textile fabrics, and particularly non-woven fabrics. A particularly advantageous application is the manufacture of nappies, towels, liners and the like.

The core component may consist of conventional melt-spinnable polyester material. All known types suitable for fibre manufacture may be considered in principle as polyester material. Such polyesters consist essentially of components which derive from aromatic dicarbonic acids and from aliphatic diols. Commonly used aromatic dicarbonic acid components are the bivalent residues of benzol dicarbonic acids, particularly of terephthalic acid and isophthalic acid; commonly used diols have 2 to 4 C atoms, ethylene glycol being particularly suitable.

Of particular advantage is a polyester material at least 85 mol % of which consists of polyethylene terephthalate. The remaining 15 mol % are then composed of dicarbonic acid units and glycol units which act as so-called modifiers and which enable the expert to further influence the physical and chemical properties of the fibres produced in a specific manner. Examples of such dicarbonic acid units are residues of isophthalic acid or of aliphatic dicarbonic acid, e.g. glutaric acid, adipinic acid, sabacic acid; examples of diol residues with a modifying action are those of longer chain diols, e.g. of propane diol or butane diol, of di- or triethylene glycol or, if available in a small quantity, of polyglycol with a molecular weight of 500 to 2000 g/mol.

Particularly preferable are polyesters which contain at least 95 mol % of polyethylene terephthalate, particularly those of unmodified polyethylene terephthalate. Such polyesters normally have a molecular weight equivalent to an intrinsic viscosity (IV) of 0.5 to 1.4 (dl/g), measured on solutions in dichloroacetic acid at 25° C.

It is important for the melting point of the polyester component to differ from that of the polyethylene component by at least 30° C. because the lower melting component, namely the polyethylene, may or should serve as a bonding material in the manufacture of bonded non-woven fabrics, other textile fabrics and other hygiene products.

Devices of prior art, with suitable nozzles, may be used for manufacturing fibres with a core/skin profile where the core occupies an eccentric position. It is essential for the core not to lie centred and symmetrically in the cross-section, but eccentrically. It is an advantage for the core to be displaced as far as possible from the centre to the periphery, and a particular advantage is the position with extreme eccentricity, i.e. where the core component reaches the edge of the skin component, according to a configuration shown in FIG. 1, i.e. it has at least one point in common tangentially of the periphery of the cross-section. The spinning speed in the method according to the invention is between 600 and 2,000, preferably between 600 and 1,400 m/min.

The escape speed on the nozzle escape surface is matched to the spinning speed and the drawing ratio so that a fibre is produced with the desired titre, i.e. a titre of approx. 2 to 7 dtex.

The spinning speed is understood to be the speed at which the solidified filaments are pulled off. The filaments thus pulled off may either be guided directly to the area of drawing or first wound on and stretched at the ratio $VV_{max}$ later.

The required ratio $VV_{max}$ is determined as follows.

Bicomponent filaments of the core/skin type—such as that described above—are spun with an eccentric position of the core, and approximately 10 samples are then drawn individually at different ratios of between 1.2 and 2.6, the drawing ratios varying by approx. 0.1, i.e. they are 1.2, 1.3; 1.4 . . . to 2.6.

For all the samples the drawing takes place at the same temperature of between 40 and 70° C., preferably at 55° C. The samples are then crimped in a stuffer box. After crimping in the stuffer box the fibres are subjected to heat treatment at 120° C., with a holding time of 3 minutes. The number of arcs per centimeter is then counted for each sample and crimping K1 is determined according to DIN standard 53840. The values obtained are represented graphically as a function of the drawing ratio.

Figure 2:
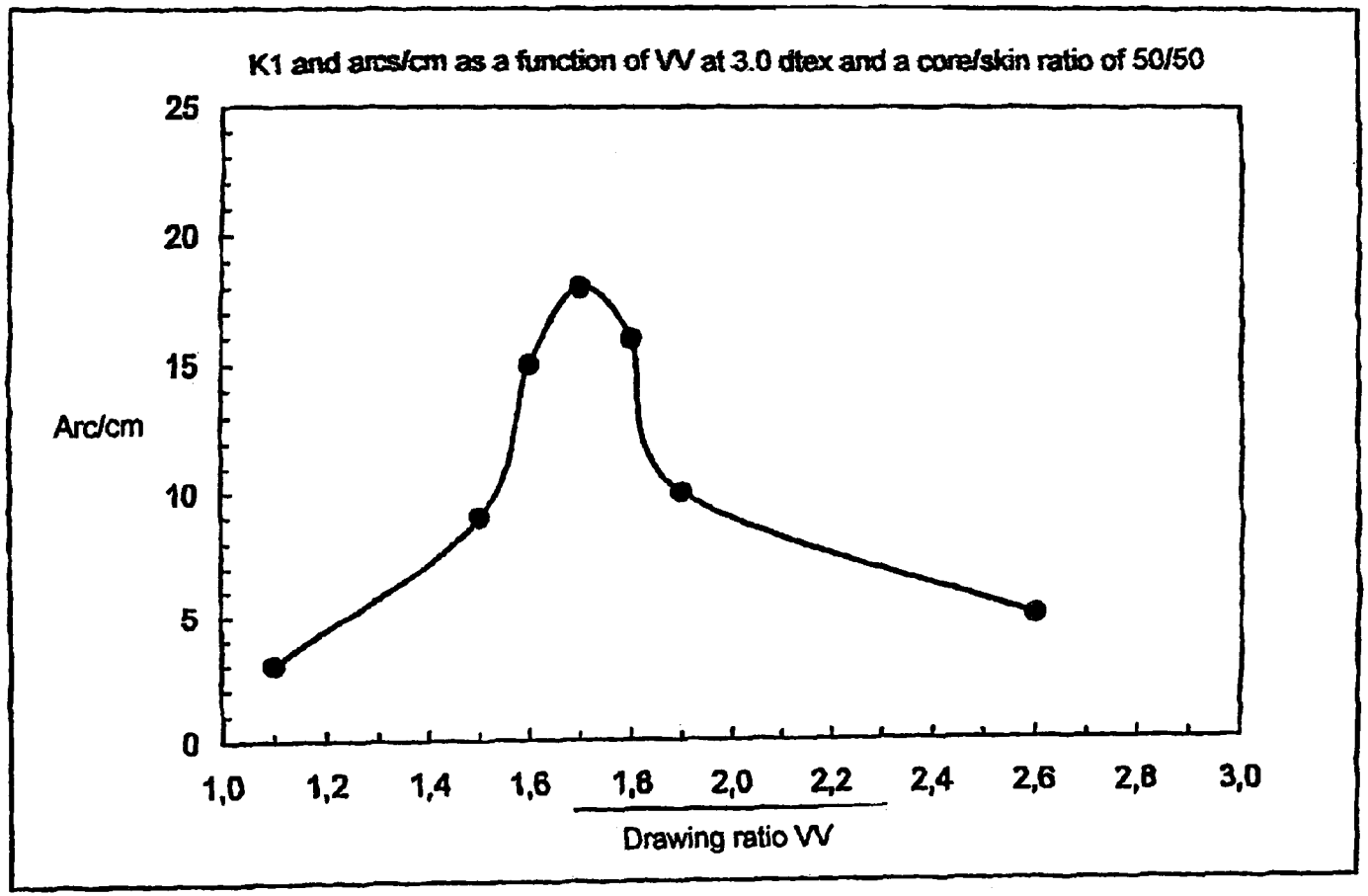
FIG. 2 shows a plot suitable for determination of the value $W_{max}$ for a fibre made according to the disclosure.

FIG. 2 shows a suitable determination of the value $VV_{max}$ for a fibre with a titre of 3.0 dtex and a core/skin ratio of 50:50. The value $VV_{max}$ is 1.7.

The $VV_{max}$ value is read off as the maximum of the number of arcs/cm curve (as Y-axis) and drawing ratio (X-axis), and serves as a process parameter for the method according to the invention.

This is the optimum value at which eccentric bicomponent fibres having a core/skin ratio of 50:50 and a titre after drawing of 3 dtex are manufactured according to the invention. Similarly, the ratio $VV_{max}$ for bicomponent fibres with other titres, ranging from 2 to 7 dtex, and other core/skin ratios, can be determined by corresponding tests.

Figure 3:
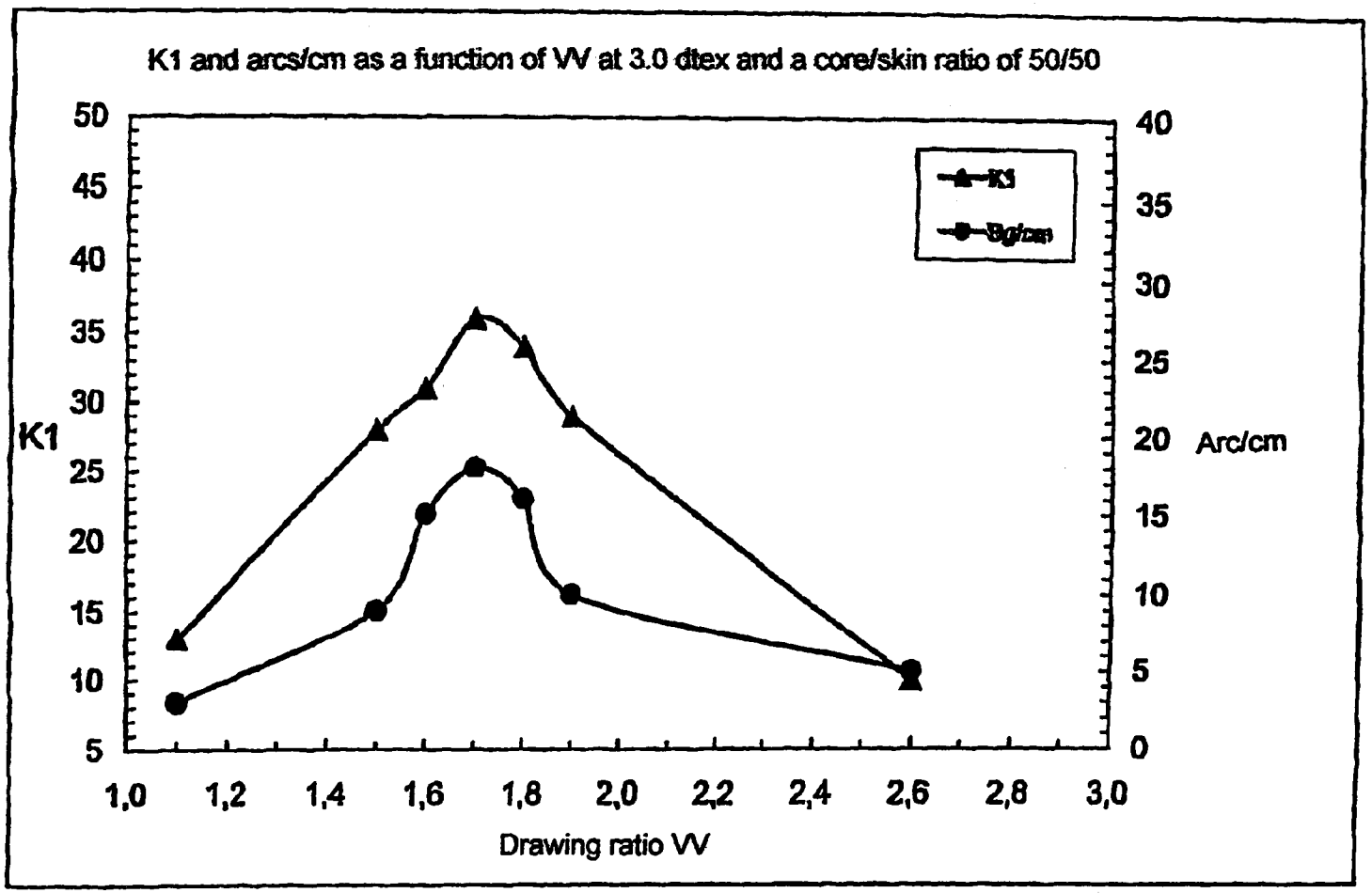
FIG. 3 shows a plot of crimping K1 as a function of W from an exemplary fibre.

The maximum crimping K1 may correspond to the maximum for the number of arcs, but need not. FIG. 3 also shows the development of crimping K1 as a function of W.

After $VV_{max}$ is determined the method according to the invention can be carried out on a production scale.

The fibres drawn at the ratio $VV_{max}$ are then stuff-crimped. The stuff-crimped fibres may be cut into staple fibres, then processed into suitable products, in particular textile products, preferably hygiene products, hygiene textile fabrics, hygiene non-woven fabrics, nappies, towels or liners and the like, but also into cotton wool buds etc.

As a result of the method according to the invention the fibres are given an additional latent crimp which, during further processing, can be initiated by heat treatment at temperatures exceeding approx. 100° C. Here the number of arcs already obtained by crimping in the stuffer box is further increased.

The fibre therefore not only has a soft feel but also contributes to improving the bulk of the corresponding products. The non-woven fabric can be suitably strengthened by suitable heat treatment at temperatures at which the skin component becomes soft or begins to melt.

It was particularly surprising to discover that it is possible, using the method according to the invention with a relatively low drawing ratio, to obtain fibres which, in addition to the arcs due to stuff-crimping, also have an increased number of arcs due to the initiation of the latent crimping capacity. This was particularly surprising as the general view was that an increase in intensity of the latent crimping capacity only takes place if there is a continuous increase in drawing.

The invention is explained in greater detail by means of the following example:

EXAMPLE

Spun product is produced on a bicomponent spinning installation with an eccentric cross-section from standard polyester in the core, and polyethylene in the skin. The total throughout, at a core/skin ratio of 50/50, was 380 g/min per spinning point with an 827 hole nozzle. The individual spinning titre set here was 4.60 dtex. The drawing off speed was 1,000 m/min. The mass temperature of the polyester was 285° C., that of the polyethylene 265° C. The spun filaments were cooled by internal/external blowing over a blowing length of 500 mm and with a volumetric air flow of 280 $m^3$/h, at an air temperature of 40° C. Before they were plied together the filaments were also prepared with the normal dressing.

The spun product was then fed to a conventional fibre belt conveyor and processed further. The drawing in the area indicated, particularly in the specific case for a final titre of 3.0 dtex, took place at a drawing ratio of 1.7 between rotating rolls. The roll temperature at which the drawing was initiated was 50° C. After subsequent drying of the cable, again on rotating rolls at a temperature of 105° C., the fibre cable was mechanically crimped in a stuffer box crimping machine, then dried at 60° C. in a flat belt dryer. The fibres were cut with a conventional staple fibre cutting machine.

The invention claimed is:

1. Method for manufacturing an eccentric bicomponent fibre composite of the core/skin type with a soft feel and having improved latent crimping, comprising:

manufacturing an eccentric core/skin fibre composite, with a skin portion comprising 35% to 70% of the cross section of the fibre composite, by melt spinning polyethylene terephthalate as the core component and polyethylene as the skin component, at a spinning speed of 600 m/min to 2,000 m/min, drawing the fibre thus obtained at a temperature of 40° C. to 70° C. and at a total drawing ratio $VV_{max}$ in a range of 1.4 to 2.4 in a single drawing stage, then stuff-crimping the drawn fibre, $VV_{max}$ being the drawing ratio at which the number of arcs per cm reaches a maximum.

2. Method according to claim 1, wherein the spinning speed is 600 m/min to 1,400 m/min.

3. Method according to claim 1 comprising drawing at a temperature of 50° C. to 60° C.

4. Method according to claim 1 comprising manufacturing the bicomponent fibre as a core/skin fibre with extreme eccentricity.

5. Method according to claim 1 comprising manufacturing the fibre with a titre, after drawing, of 2 dtex to 7 dtex.

6. Method according to claim 1, wherein the melting point of the core component is at least 30° C. higher than the melting point of the skin component.

7. Method for manufacturing an eccentric bicomponent fibre composite of the core/skin type with a soft feel and having improved latent crimping, comprising:

manufacturing an eccentric core/skin fibre composite, with a skin portion comprising 35% to 70% of the cross section of the fibre composite, by melt spinning polyethylene terephthalate as the core component and polyethylene as the skin component, at a spinning speed of 600 m/min to 2,000 m/min, drawing the fibre thus obtained at a temperature of 40° C. to 60° C. and at a total drawing ratio $VV_{max}$ in a range of 1.4 to 2.4 in a single drawing stage, then stuff-crimping the drawn fibre, $VV_{max}$ being the drawing ratio at which the number of arcs per cm reaches a maximum.

8. Method according to claim 7, wherein the melting point of the core component is at least 30° C. higher than the melting point of the skin component.

9. Method for manufacturing an eccentric bicomponent fibre composite of the core/skin type with a soft feel and having improved latent crimping, comprising:

manufacturing an eccentric core/skin fibre composite, with a skin portion comprising 35% to 70% of the cross section of the fibre composite, by melt spinning polyethylene terephthalate as the core component and polyethylene as the skin component, at a spinning speed of 600 m/min to 2,000 m/min, drawing the fibre thus obtained at a temperature of 40° C. to 70° C. and at a total drawing ratio $VV_{max}$ in a range of 1.4 to 2.4 in a single drawing stage, with a titre in a range of 2 dtex to 7 dtex, then stuff-crimping the drawn fibre, $VV_{max}$ being the drawing ratio at which the number of arcs per cm reaches a maximum.

10. Method according to claim 9, wherein the melting point of the core component is at least 30° C. higher than the melting point of the skin component.

11. Method according to claim 1, wherein the total drawing ratio VVmax is in a range of 1.4 to 1.9.

12. Method according to claim 7, wherein the total drawing ratio VVmax is in a range of 1.4 to 1.9.

13. Method according to claim 9, wherein the total drawing ratio VVmax is in a range of 1.4 to 1.9.

14. Method according to claim 1, comprising cutting the stuff-crimped fibers, forming a nonwoven from the cut fibers, heating the nonwoven to release the latent crimp, and then further heating and thermobonding the nonwoven.

15. Method according to claim 1, further comprising processing the fibre composite into a hygiene product.

16. Method according to claim 1, further comprising processing the fibre composite into a hygiene textile fabric.

17. Method according to claim 1, further comprising processing the fibre composite into a non-woven hygiene-textile fabric.

18. Method according to claim 1, further comprising processing the fibre composite into a nappy.

19. Method according to claim 1, further comprising processing the fibre composite into a towel or liner.

* * * * *

UNITED STATES PATENT AND TRADEMARK OFFICE

CERTIFICATE OF CORRECTION

PATENT NO. : 7,927,530 B2
APPLICATION NO. : 10/504472
DATED : April 19, 2011
INVENTOR(S) : Jörg Dahringer et al.

It is certified that error appears in the above-identified patent and that said Letters Patent is hereby corrected as shown below:

On the Title Pg:

Item (54) and Col. 1, line 2, "BICOMPO NENT" should be -- BICOMPONENT --.

Signed and Sealed this
First Day of May, 2012

David J. Kappos

David J. Kappos
*Director of the United States Patent and Trademark Office*